US010046466B2

(12) United States Patent
Wang

(10) Patent No.: US 10,046,466 B2
(45) Date of Patent: Aug. 14, 2018

(54) UTILITY KNIFE WITH REPLACEABLE BLADE

(71) Applicants: Hangzhou Great Star Tools Co., Ltd., Hangzhou, Zhejiang Province (CN); Hangzhou Great Star Industrial Co., Ltd., Hangzhou, Zhejiang Province (CN)

(72) Inventor: Weiyi Wang, Hangzhou (CN)

(73) Assignees: Hangzhou Great Star Tools Co., Ltd. (CN); Hangzhou Great Star Industrial Co., Ltd. (CN)

( * ) Notice: Subject to any disclaimer, the term of this patent is extended or adjusted under 35 U.S.C. 154(b) by 0 days.

(21) Appl. No.: 15/624,203

(22) Filed: Jun. 15, 2017

(65) Prior Publication Data

US 2017/0282384 A1 Oct. 5, 2017

Related U.S. Application Data

(63) Continuation of application No. 13/583,459, filed as application No. PCT/CN2012/073566 on Apr. 6, 2012.

(30) Foreign Application Priority Data

Mar. 31, 2012 (CN) ..... 2012 1 0093266

(51) Int. Cl.
*B26B 1/04* (2006.01)
*B26B 5/00* (2006.01)

(52) U.S. Cl.
CPC ..... *B26B 5/00* (2013.01); *B26B 1/042* (2013.01)

(58) Field of Classification Search
CPC ..... B26B 5/00; B26B 1/042
(Continued)

(56) References Cited

U.S. PATENT DOCUMENTS 4,292,738 A 10/1981 Osada
5,613,300 A 3/1997 Schmidt
(Continued)

FOREIGN PATENT DOCUMENTS

CN 1092559 C 10/2002
CN 2691805 Y 4/2005
(Continued)

OTHER PUBLICATIONS

First Office Action for Chinese Application No. 102672730, w/English-language Translation, dated Nov. 21, 2013; 44 pages.
(Continued)

*Primary Examiner* — Sean Michalski
(74) *Attorney, Agent, or Firm* — Blank Rome LLP

(57) ABSTRACT

The present invention first provides a utility knife with a replaceable blade, comprising a knife handle, a blade holder, a blade and a locking device that locks the blade in the blade holder. The blade holder and the blade are enabled to switch between a first position and a second position. When the blade holder and the blade are in the first position, the blade is used for cutting operation, and when the blade holder and the blade are in the second position, both the blade holder and the blade are received in the knife handle. The utility knife further includes a restriction means which is thus arranged as, when the blade holder is in the second position and the locking device is in unlocked state, the restriction means is used for preventing the detachment of the blade from the blade holder by confining the movement of the blade relative to the blade holder. The present invention also provides a folding utility knife with a replaceable blade and a retractable utility knife with a replaceable blade, and a utility knife with multiple tools and replaceable blades.

4 Claims, 10 Drawing Sheets

(58) Field of Classification Search
USPC ..... 30/144, 2
See application file for complete search history.

(56) References Cited

U.S. PATENT DOCUMENTS

| | | | | |
|---|---|---|---|---|
| 5,621,973 | A | 4/1997 | Seber et al. | |
| 5,870,828 | A | 2/1999 | Polites | |
| 6,205,667 | B1 | 3/2001 | Glesser | |
| 6,233,832 | B1 | 5/2001 | Berns | |
| 7,716,839 | B2 | 5/2010 | Onion | |
| 7,814,664 | B2 * | 10/2010 | LeBlanc | B26B 5/00 30/156 |
| 7,886,444 | B2 * | 2/2011 | Kao | B26B 1/044 30/159 |
| 7,900,363 | B1 * | 3/2011 | White | B25F 1/02 30/151 |
| 7,913,398 | B2 * | 3/2011 | Chu | B26B 1/042 30/160 |
| 7,937,840 | B2 * | 5/2011 | Chen | B23D 51/10 30/329 |
| 8,006,391 | B1 * | 8/2011 | Mashburn | B26B 5/00 30/156 |
| 8,109,002 | B2 * | 2/2012 | Frazer | B26B 11/00 30/123 |
| 8,286,356 | B1 * | 10/2012 | Mollick | B26B 1/042 30/155 |
| 8,296,958 | B1 * | 10/2012 | Frazer | B26B 1/042 30/155 |
| 8,347,509 | B2 * | 1/2013 | Votolato | B25F 1/003 30/151 |
| 8,464,382 | B2 * | 6/2013 | Chu | B26B 11/006 7/118 |
| 9,808,942 | B2 * | 11/2017 | Wang | B26B 5/00 |
| 9,840,013 | B2 * | 12/2017 | Garavaglia | B26B 29/02 |
| 2004/0226175 | A1 | 11/2004 | Ping | |
| 2005/0204567 | A1 * | 9/2005 | Ping | B26B 1/042 30/161 |
| 2005/0274024 | A1 * | 12/2005 | Jinliang | B26B 1/042 30/153 |
| 2006/0026844 | A1 * | 2/2006 | Ping | B26B 1/046 30/153 |
| 2006/0272157 | A1 | 12/2006 | Zeng | |
| 2007/0006466 | A1 * | 1/2007 | Ping | B26B 1/044 30/152 |
| 2007/0107232 | A1 * | 5/2007 | Green | B26B 5/001 30/162 |
| 2007/0294895 | A1 * | 12/2007 | Ping | B26B 1/042 30/156 |
| 2008/0086894 | A1 * | 4/2008 | Sullivan | B26B 5/00 30/155 |
| 2008/0250650 | A1 | 10/2008 | Seber et al. | |
| 2008/0289191 | A1 | 11/2008 | LeBlanc | |
| 2009/0199408 | A1 | 8/2009 | Zeng | |
| 2010/0299935 | A1 | 12/2010 | Ping | |
| 2011/0197454 | A1 | 8/2011 | Zeng | |
| 2011/0271531 | A1 | 11/2011 | Huang | |
| 2012/0023754 | A1 | 2/2012 | Chang | |
| 2013/0199047 | A1 | 8/2013 | Herlitz | |
| 2013/0255087 | A1 | 10/2013 | Wang | |

FOREIGN PATENT DOCUMENTS

| | | | |
|---|---|---|---|
| CN | 2850854 | Y | 12/2006 |
| CN | 2882931 | | 3/2007 |
| CN | 201098899 | | 8/2008 |
| CN | 201151124 | | 11/2008 |
| CN | 101518905 | A | 9/2009 |
| CN | 200910048668.2 | | 9/2009 |
| CN | 201333704 | | 10/2009 |
| CN | 201346778 | Y | 11/2009 |
| CN | 200920050771.6 | | 11/2009 |
| CN | 201020261986.5 | | 1/2010 |
| CN | 101875200 | | 11/2010 |
| CN | 101885183 | A | 11/2010 |
| CN | 201720851 | U | 1/2011 |
| CN | 201907124 | | 7/2011 |
| CN | 20260375 | | 1/2013 |
| CN | 202640372 | | 1/2013 |
| CN | 202640373 | | 1/2013 |
| CN | 202640374 | | 1/2013 |
| GB | 2416729 | A | 2/2006 |
| WO | WO2012019579 | A2 | 2/2012 |

OTHER PUBLICATIONS

Second Office Action for Chinese Application No. 12672730, w/English-languate Translation, dated Jul. 11, 2014; 40 pages.
Third Office Action for Chinese Application No. 102672730, w/English-language Translation, dated Jan. 12, 2015; 14 pages.
Definition of "assembly" obtained May 19, 2015 from http://www.merriam-webster.com/dictionary/assembly.
International Search Report for corresponding application PCT/CN2012/073566 dated Jan. 17, 2013.

* cited by examiner

UTILITY KNIFE WITH REPLACEABLE BLADE

CROSS-REFERENCE TO RELATED APPLICATIONS

The present patent application is a continuation of prior U.S. patent application Ser. No. 13/583,459, filed Dec. 26, 2012, and entitled "UTILITY KNIFE WITH REPLACEABLE BLADE," which is a 35 U.S.C. § 371 National Phase conversion of International Application No. PCT/CN2012/073566, filed Apr. 6, 2012. The PCT International Application was published in the Chinese language, and claims priority benefits to Chinese Patent Application No. 201210093266.6 filed Mar. 31, 2012. The entire contents of each of these applications are incorporated herein by reference.

FIELD OF THE INVENTION

The invention relates to the field of utility knives with replaceable blade, and specifically to a safety utility knife which is capable of preventing the accidental detachment of blades and belongs to the field of hand tools.

DESCRIPTION OF THE PRIOR ART

Folding and retractable utility knives with replaceable blade are widely used, which is characterized by that the blades are enabled to be swiftly replaced and the knife is easy to carry.

A utility knife with a replaceable blade generally includes a blade holder which can be folded into the knife handle, a blade mounted to the blade holder and a locking device for retaining the blade in the blade holder. When the blade needs to be replaced, firstly, extend the blade holder and then set the locking device to unlocked state thereby to pull out the blade from the blade holder for replacement.

In the prior art there also exists a folding utility knife with a replaceable blade having a back-lock structure which generally includes a latch pivotally arranged on the back of the utility knife. When the blade holder is fully extended, the latch pivots under the effect of a spring and is locked in the recess at the end of the blade holder, thereby locking the blade holder in the extended position. Only when the latch is pressed, will the blade holder detach from the recess so as to fold the blade holder into the knife handle. This back-lock structure is disclosed in the Chinese Patent No. CN201020261986.5, titled 'Cutting knife'.

In the prior art there further exists a folding utility knife with a replaceable blade having a side-lock structure, which generally includes a deflection leaf spring arranged in the knife handle. When the blade holder is in full extension, the deflection leaf spring, by its own resilient force, deflects and is locked in the locking part at the end of the blade holder, thereby locking the blade holder in the extending position. Only when the leaf spring is laterally pushed, the blade holder is then detached from the locking part so as to be folded into the handle of the blade holder. This side-lock structure is disclosed in the Chinese Patent No. CN200920050771.6 titled 'A new type of folding knife'.

And there is also a retractable utility knife with a replaceable blade in the prior art It includes a knife holder which is retractable into the knife handle by sliding, a blade locked in the knife holder and the locking device to lock the blade to the knife. Besides, generally a push button connected to the knife holder is also included, by pressing and pushing the button, the blade holder will be slid into or out of the knife handle. When the blade needs to be replaced, firstly slide the blade holder out of the knife handle and then set the locking device to unlocked state, thereby pull out the blade from the blade holder for replacement. This retractable structure is disclosed in the Chinese Patent No. CN200910048668.2 titled 'Cutting knife'.

The current locking devices used by the utility knives with replaceable blades have multiple forms, but generally they all include a switching member which is operated to switch the locking devices between locked and unlocked states.

FIGS. 1 and 2 show a common locking device used in utility knife with replaceable blade, which includes a switching member 1, a locking member 2 and a spring member 3, wherein in locked state, the locking member 2 is clamped in the notch 4 at the back of the blade under the effect of the spring member 3 as shown in FIG. 1; when unlocking, press the switching member 1 to compress the spring member 3 and tilt the locking member 2 so as to detach the locking member 2 from the notch 4, and then the locking device is in unlocked state such that the blade 5 can be directly pulled out, as shown in FIG. 2.

FIGS. 3 to 6 show another locking device used for utility knife with replaceable blade, which includes a switching member 1, a locking member 2 and a spring member 3, wherein in locked state, the locking member 2 is clamped in the notch at the back of the blade under the effect of the spring member 3, as shown in FIG. 3 and FIG. 4; when unlocking, press the switching member 1 to compress the spring member 3 and deflect the locking member 2 so as to detach the locking member 2 from the notch 4, and then the locking device is in unlocked state such that the blade 5 can be directly pulled out, as shown in FIG. 5 and FIG. 6.

The foregoing are just two examples of common locking devices, and there exist many locking devices used for swift replacement of blades in prior art. No matter which one of the locking device is adopted, defects exist in this type of utility knives with replaceable blades and are shown as below: for convenience of operation, the switching members are normally disposed in an easily accessible position, where even if the blade and the blade holder are kept in the utility handle such as when carried by the user in a pocket, the switching member may be unintentionally touched, causing the locking device switch to unlocked state, so that the blade may detach from the blade holder and the sharp blade may very likely cause harm to the user, as shown in FIG. 7. This safety hazard can bring serious consequences and should be avoided with due diligence.

In order to overcome the defects, an object of the present invention is to provide a safety utility knife with replaceable blade.

SUMMARY OF THE INVENTION

In view of the technical defects of prior art, the technical problem which the present invention aims to solve is to provide a safety utility knife with replaceable blades.

In order to achieve the above object, the present invention on the first aspect provides a utility knife with a replaceable blade, including a knife handle, a blade holder, a blade and a locking device that locks the blade in the blade holder and enables the blade holder and the blade to switch between a first position and a second position. When the blade holder and the blade are in the first position, the blade is used for cutting operation, and when the blade holder and the blade are in the second position, both the blade holder and the blade are retained within the knife handle, and the utility knife further includes a restriction means which is thus set up as, when the blade holder is in the second position and the locking device is in unlocked state, the restriction means is used for preventing the detachment of the blade from the blade holder by restricting the movement of the blade relative to the blade holder.

In a preferred embodiment of the present invention, the restriction means is a projection that blocks the blade in the second position and avoids the detachment thereof from the blade holder.

In a further preferred embodiment of the present invention, the projection is disposed on an inner side of the knife handle.

In a further preferred embodiment of the present invention, the projection and the knife handle are integrally modeled.

In a further preferred embodiment of the present invention, the projection is arranged to be adjacent to the blade.

In a further preferred embodiment of the present invention, the blade in the second position is simultaneously restricted in the sliding outward direction and the downward direction by the projection.

In a further preferred embodiment of the present invention, there is one or more said projections.

In a further preferred embodiment of the present invention, the restriction means includes a protective cover sheathing the blade, and the protective cover detachably mounted on the blade holder.

In a further preferred embodiment of the present invention, the protective cover includes a button-hole part which is matched with the button arranged on the blade holder.

In a further preferred embodiment of the present invention, the button-hole part is connected with the body of the protective cover via a flexible part.

The present invention on the second aspect provides a folding utility knife with a replaceable blade, including a knife handle, a blade holder, a blade and a locking device that locks the blade in the blade holder and enables the blade holder and the blade to be folded and received the knife handle or to extend out from the knife handle, and the utility knife further includes a restriction means which is thus arranged that, when the blade holder and the blade are folded and received in the knife handle and the locking device is in unlocked state, the restriction means is used for preventing the detachment of the blade from the blade holder by restricting the movement of the blade relative to the blade holder.

In a preferred embodiment of the present invention, the restriction means is a projection blocking the blade from detachment thereof from the blade holder.

In a further preferred embodiment of the present invention, the projection is disposed on an inner side of the knife handle.

In a further preferred embodiment of the present invention, the projection and the knife handle are integrally modeled.

In a further preferred embodiment of the present invention, the projection is arranged to be adjacent to the blade.

In a further preferred embodiment of the present invention, the blade the blade received into the knife handle is simultaneously restricted in the sliding outward direction and the downward direction by the projection.

In a further preferred embodiment of the present invention, there is one or more said projections.

In a further preferred embodiment of the present invention, the restriction means includes a protective cover sheathing the blade, with the protective cover detachably mounted on the blade holder.

In a further preferred embodiment of the present invention, the protective cover includes a button-hole part which is matched with the button arranged on the blade holder.

In a further preferred embodiment of the present invention, the button-hole part is connected with the protective cover via a flexible part.

In a further preferred embodiment of the present invention, the folding utility knife with a replaceable blade has a back-lock structure.

In a further preferred embodiment of the present invention, the folding utility knife with a replaceable blade has a side-lock structure.

In a further preferred embodiment of the present invention, the projection extends from a side of the deflection leaf spring arranged inside the knife handle.

In a further preferred embodiment of the present invention, the projection is formed by bending a part of the deflection leaf spring.

The present invention on the third aspect provides a retractable utility knife with a replaceable blade, including a knife handle, a blade holder, a blade and a locking device that locks the blade in the blade holder, the blade holder and the blade are enabled to be received in the knife handle or to extend out from the knife handle by sliding, and the utility knife further includes a restriction means which is thus arranged that, when the blade holder and the blade are folded to be received in the knife handle and the locking device is in unlocked state, the restriction means is used for preventing the detachment of the blade from the blade holder by restricting the movement of the blade relative to the blade holder.

In a preferred embodiment of the present invention, the restriction means includes a protective cover sheathing the blade, and the protective cover is detachably mounted to the blade holder.

In a further preferred embodiment of the present invention, the protective cover includes a button-hole part which is matched with the button arranged on the blade holder.

In a further preferred embodiment of the present invention, the button-hole part is connected with the body of the protective cover via a flexible connection.

The present invention on the fourth aspect provides a utility knife with replaceable blades, including a knife handle and multiple tools, the tools enabled to be received in the knife handle respectively via folding or sliding or to extend out from the knife handle. At least one of the tools includes a blade holder, a blade and a locking device that locks the blade in the blade holder, and the utility knife further includes a restriction means which is so arranged that, when the blade holder and the blade are received in the knife handle and the locking device is in unlocked state, the restriction means is used for preventing the detachment of the blade from the blade holder by restricting the movement of the blade relative to the blade holder.

In a preferred embodiment of the present invention, the tools are respectively disposed at either end of the knife handle.

In a further preferred embodiment of the present invention, the tools are disposed at the same end of the knife handle.

In a further preferred embodiment of the present invention, wherein the blade holder is folded and received in the knife handle or to extend out from the knife handle, and the restriction means is a projection blocking the blade from the detachment thereof from the blade holder.

In a further preferred embodiment of the present invention, the projection is disposed on an inner side of the knife handle.

In a further preferred embodiment of the present invention, the projection and the knife handle are integrally modeled.

In a further preferred embodiment of the present invention, the projection is arranged to be adjacent to the blade.

In a further preferred embodiment of the present invention, the blade holder in the second position is simultaneously restricted in the sliding outward direction and the downward direction by the projection.

In a further preferred embodiment of the present invention, there is one or more said projections.

In a further preferred embodiment of the present invention, the restriction means includes a protective cover sheathing the blade, and the protective cover is detachably mounted to the blade holder.

In a further preferred embodiment of the present invention, the protective cover includes a button-hole part is matched with the button arranged on the blade holder.

In a further preferred embodiment of the present invention, the button-hole part is connected with the protective cover via a flexible part.

In a further preferred embodiment of the present invention, the utility knife with a replaceable blade also has a back-lock structure.

In a further preferred embodiment of the present invention, the utility knife with a replaceable blade also has a side-lock structure.

In a further preferred embodiment of the present invention, the projection extends from a side of the deflection leaf spring arranged inside the knife handle.

In a further preferred embodiment of the present invention, the projection is formed by bending a part of the deflection leaf spring.

The present invention utterly prevents the detachment of blades in received state, and eliminates the induced safety hazard of harming users, by additional arrangement of the restriction means to prior utility knives with replaceable blade.

Referencing now to the figures, the conception, detailed structure and induced technical effect of the present invention will be expounded for due understanding of the purpose, characterizations and effects of the present invention:

DETAILED DESCRIPTION OF THE PREFERRED EMBODIMENTS

As mentioned before, the present invention aims to provide a safety utility knife with replaceable blade, which is achieved by adding a restriction means to prior utility knives with replaceable blade, where the restriction means is thus arranged that, when the blade is received into the knife handle and the locking device is in an unlocked state, the restriction means is used for preventing the detachment of the blade from the blade holder.

Figure 1:
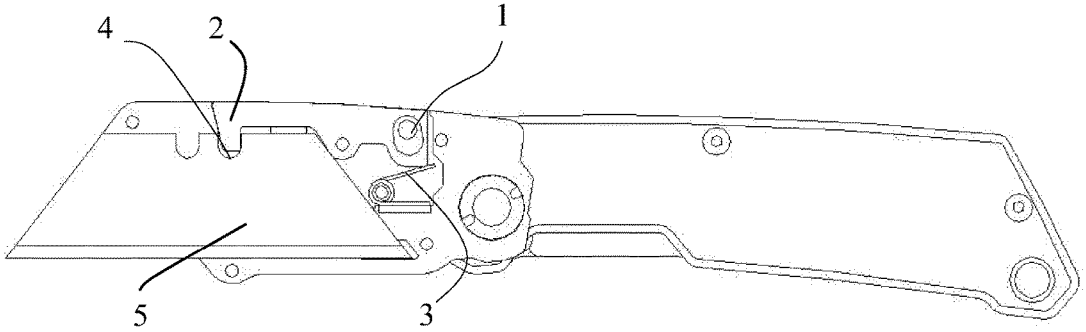
Fig. 1 Prior Art
FIG. 1 shows a locking device of the prior art, where the locking device is in a locked state.
Figure 2:
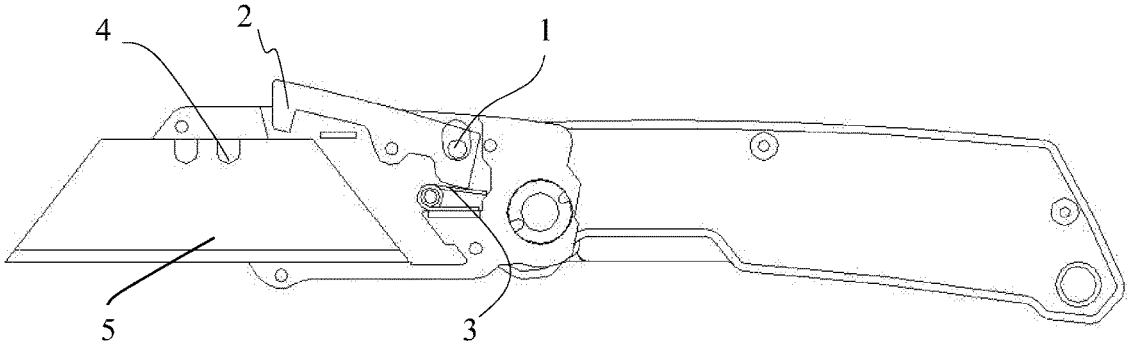
Fig. 2 Prior Art
FIG. 2 is the locking device as shown in FIG. 1 in an unlocked state.
Figure 3:
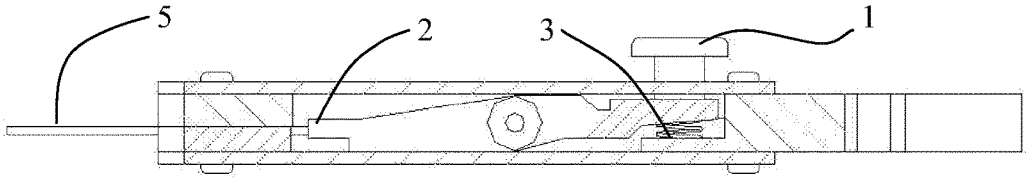
Fig. 3 Prior Art
FIG. 3 is a top view of another locking device in the prior art where the locking device is in locked state.
Figure 4:
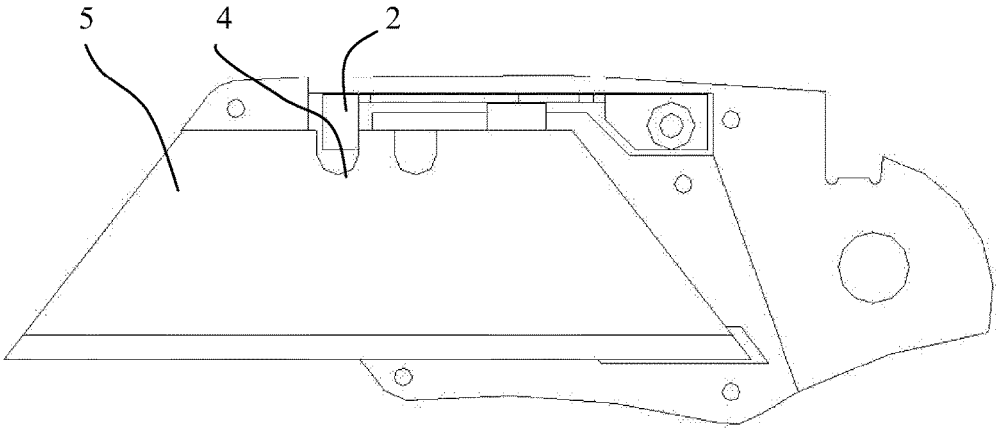
Fig. 4 Prior Art
FIG. 4 is a front view of the locking device as shown in FIG. 3.
Figure 5:
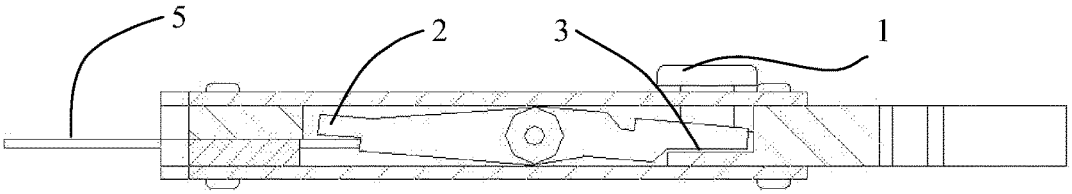
Fig. 5 Prior Art
FIG. 5 is a top view of the locking device as shown in FIG. 3 where the locking device is in an unlocked state.
Figure 6:
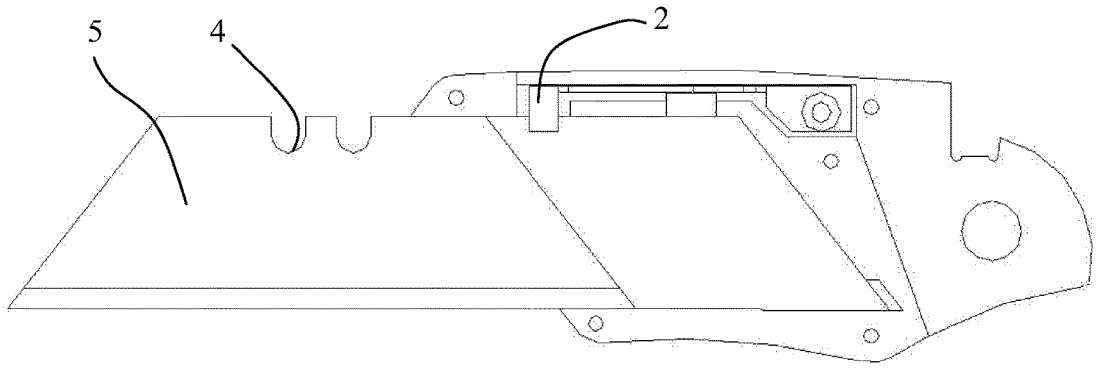
Fig. 6 Prior Art
FIG. 6 shows a locking device as shown in FIG. 3 where the blade is partially detached from the blade holder.
Figure 7:
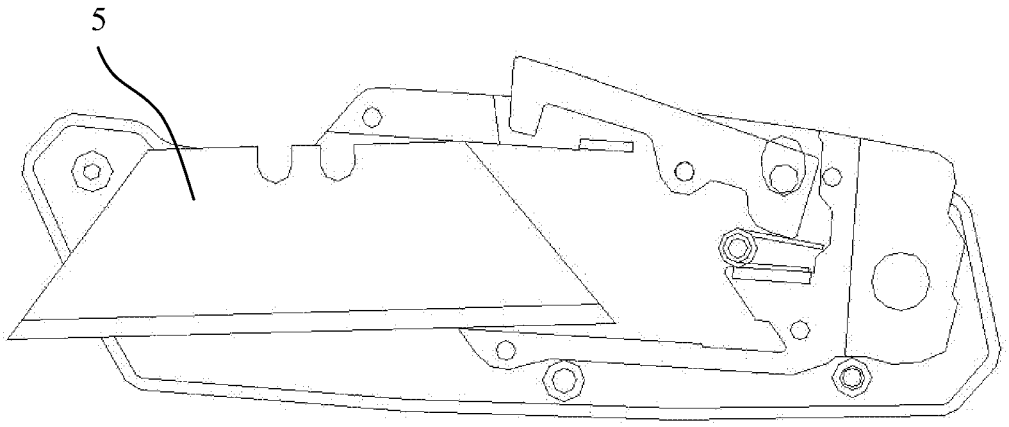
Fig. 7 Prior Art
FIG. 7 shows a perspective view of the detachment of the blade from the knife.
Figure 8:
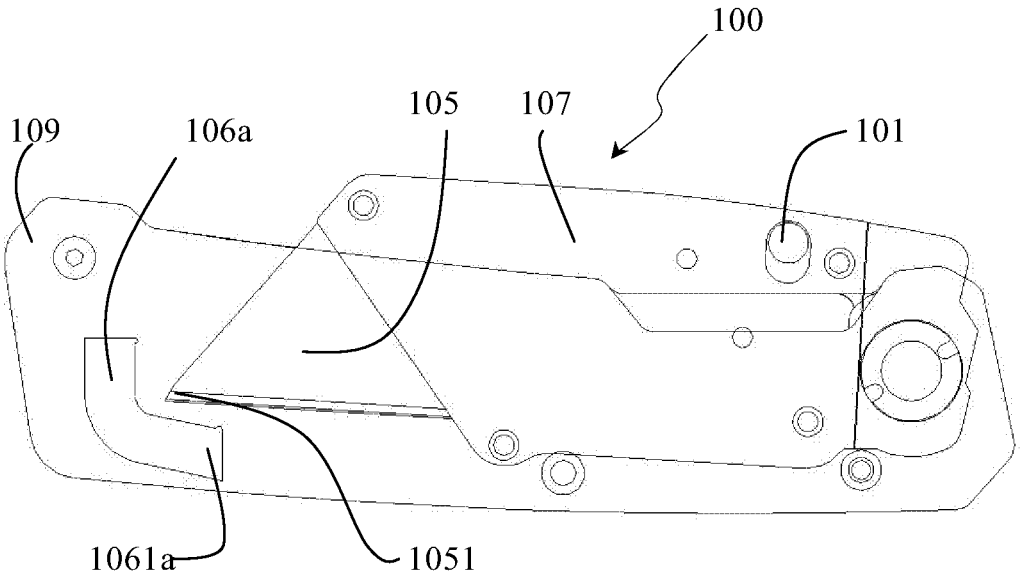
FIG. 8 shows a front view of a folding utility knife with a replaceable blade embodying the present invention.

In an embodiment of the present invention as shown in FIG. 8, 100 is a folding utility knife with a replaceable blade where the restriction means is a projection 106*a* extending from an inner side of the knife handle 109. And the blade 105 is fixed on the blade holder 107 by a locking device; when the blade holder is folded and received into the knife handle 109, the end 1051 of the knife 105 is adjacent to the projection 106*a*. When the switching member 101 is unintentionally touched upon, resulting in unlocked state of the locking device, the blade 105 is arranged to be blocked via the engagement of the end 1051 and the projection 106*a* when the blade 105 slightly slides outward from the blade holder 107, thus the detachment of the blade 105 from the blade holder 107 is prevented.

Figure 9:
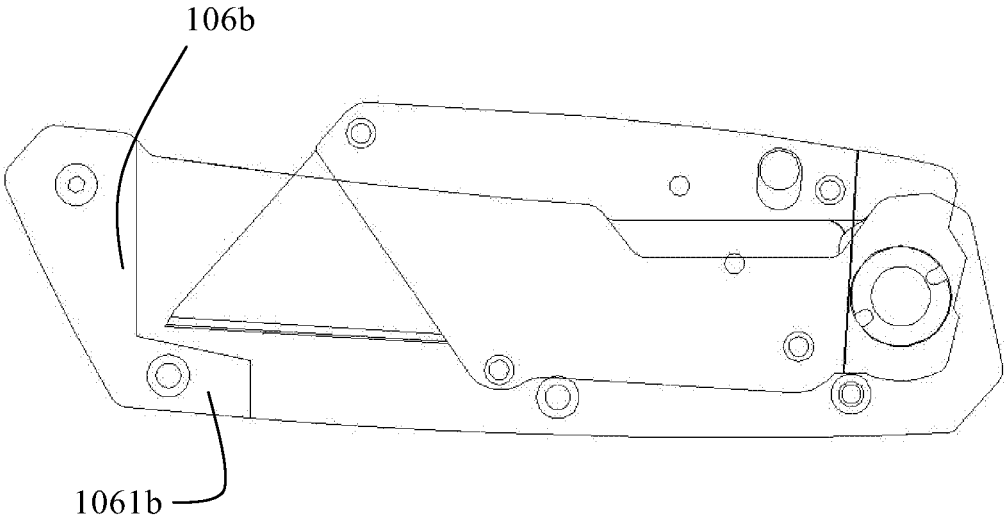
FIG. 9 shows a front view of another folding utility knife with a replaceable blade embodying the present invention

In that case, the restriction means can be an independent member 106*a* fixedly connected to an inner side of the knife handle as shown in FIG. 8, and can also be, as shown in FIG. 9, a 106*b* integrally modeled with the knife handle. Furthermore, 106*b* can also be assembled afterwards.

Figure 10:
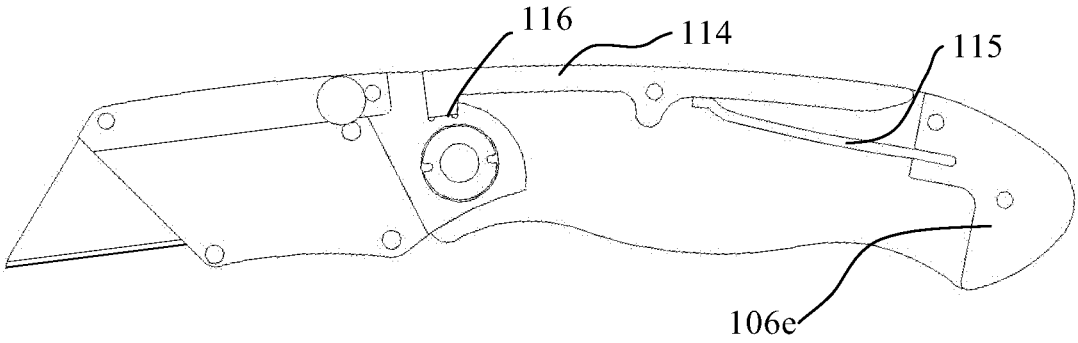
FIG. 10 shows a front view of a folding utility knife with a replaceable blade having a back-lock structure embodying the present invention.

Similarly, for the folding utility knife having a back-lock structure as shown in FIG. 10, the latch 114 as shown in the figure, under the effect of the spring 115, is locked in the notch 116 arranged at the end part of the blade holder 107, and the restriction means is a projection 106*e* arranged on an inner side of the knife handle. The projection 106*e* can also be an independent member mounted on an inner side of the knife handle, and be integrally modeled with the knife handle, or be assembled afterwards.

Figure 11:
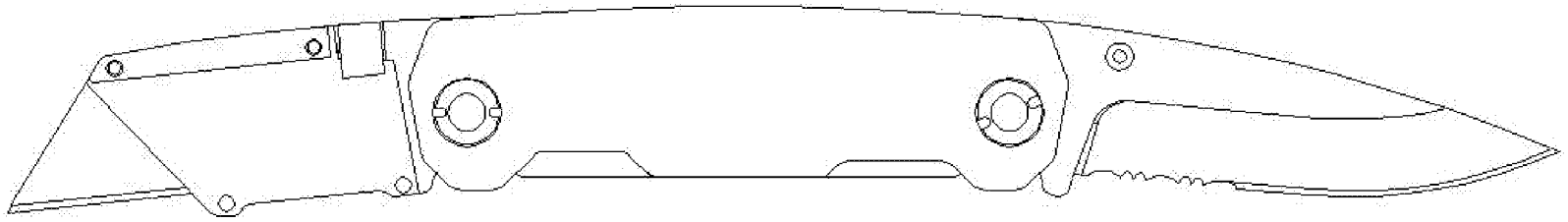
FIG. 11 shows a front view of a folding utility knife with replaceable blades having side-lock structures.
Figure 12:
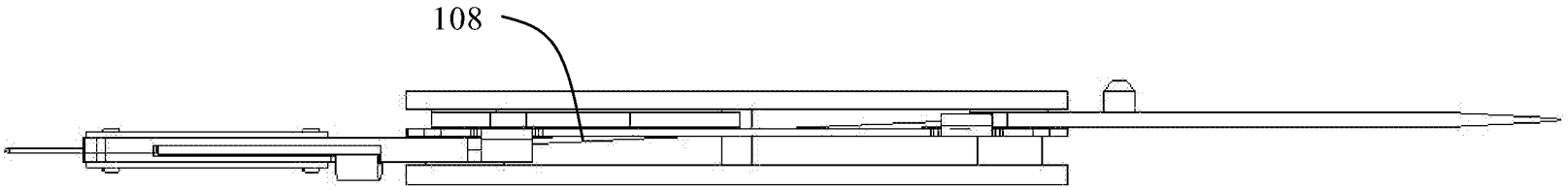
FIG. 12 is the top view of FIG. 11.
Figure 13:
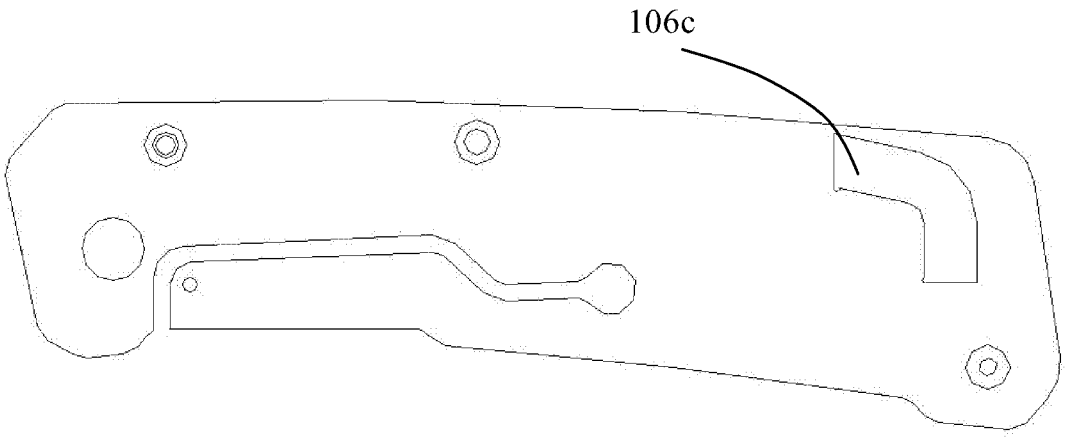
FIG. 13 shows a front view of a folding utility knife with a replaceable blade with a side-lock structure as implemented in FIG. 11 and FIG. 12 embodying the present invention.
Figure 14:
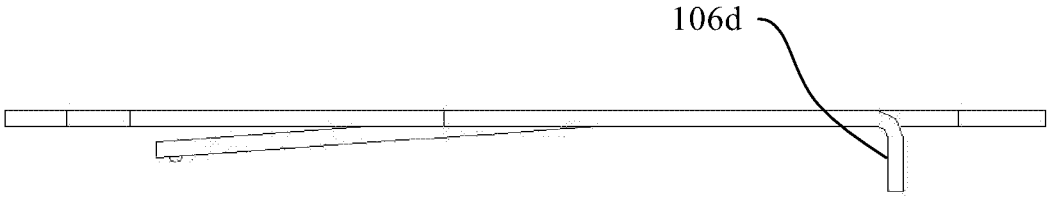
FIG. 14 shows a top view of another folding utility knife with a replaceable blade with a side-lock structure as implemented in FIG. 11 and FIG. 12 embodying the present invention.

For the folding utility knife with replaceable blades having a side-lock structure as shown in FIG. 11, where a deflection leaf spring 108 used for locking is arranged in the knife handle as shown in FIG. 12. In that case, the restriction device can also be a projection 106*c* extending from the side of the deflection leaf spring 108 as shown in FIG. 13, or a 106*d* which is formed by bending a part of the deflection leaf spring 108, as shown in FIG. 14.

In order to prevent the blade from falling off the knife, the space between the projection and the blade is thus configured so that, when the end of the blade engages with the projection, at least a part of the blade is retained in the blade holder so as to prevent full detachment of the blade from the blade holder.

However, if the projection is arranged to be too far from the blade, then when the blade reaches the projection, part of the blade already slides out of the blade holder, thus the detached blade is probably tilting in downward direction, i.e. the direction that the knife edge faces. Thus, the tilted blade, on one hand, may partially be exposed out of the knife handle, and on the other hand, the tilted blade may also be stuck between the projection and the locking member, being unable to move. A solution to the problem is to arrange the projection to be very close to the end of the blade, so that a slight movement of the blade will have the blade be blocked by the projection, thus the blade is unable to tilt. Another solution is that in addition to the projection having a portion disposed in the direction of the blade detachment from the blade holder, a portion of the projection is arranged beneath the detached blade in the direction that the blade edge faces, as the 1061*a* shown in FIG. 8 or the 1061*b* shown in FIG. 9. Besides, two projections can be simultaneously arranged, one of which is disposed in the sliding direction of the blade from the blade holder, and the other of which is disposed beneath the detached blade, so that the movements of the blade in these two directions are restricted at the same time to prevent full detachment of the blade and the downward tilting of the partially detached blade which causes a part of the blade protruding out of the knife handle.

It should be pointed out that, some of the prior folding utility knives arrange connection pin axles to both ends of the knife handle in order to connect the two pieces of handle bodies, but as known from the foregoing description, to prevent the detachment of the blade, the projection needs to be specifically arranged, and since the pin axle of the knife handle or other similar parts of the prior folding utility knife are not intentionally arranged for the purpose, thus all of them are incapable of preventing, or at least, incapable of reliably preventing the detachment of the blade.

Figure 15:
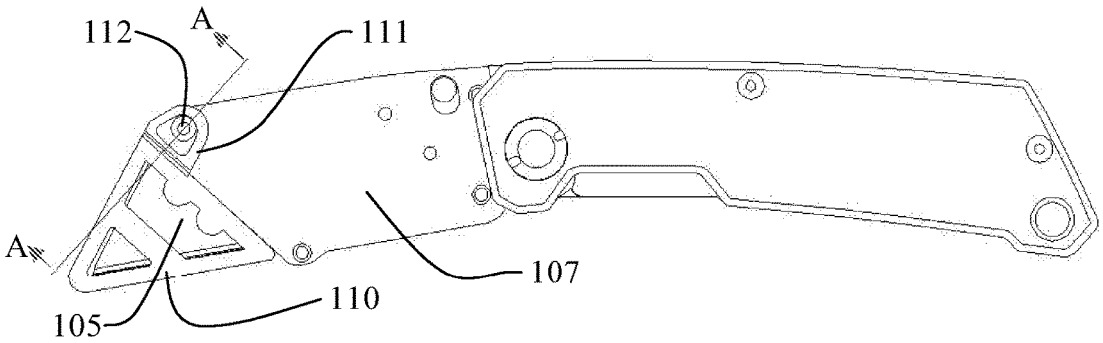
FIG. 15 shows a front view of a further embodiment of the utility knife with a replaceable blade of the present invention.
Figure 16:
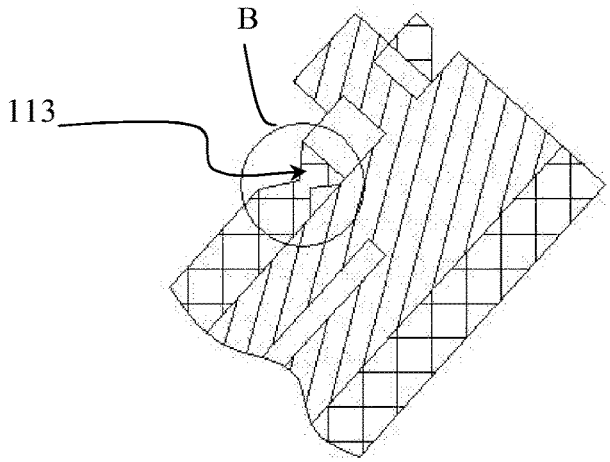
FIG. 16 is a cross-sectional view of the embodiment as shown in FIG. 15 in A-A direction.
Figure 17:
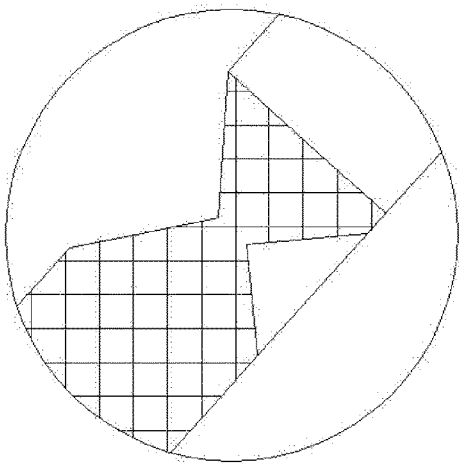
FIG. 17 is an enlarged view of part B as shown in FIG. 16.

According to an alternative embodiment of the present invention as shown in FIG. 15, the restriction means is a protective cover 110 sheathing the blade 105, the protective cover 110 is provided with a button-hole part 111, and a button 112 is arranged on the blade holder 107. The protective cover 110 is mounted to the blade holder 107 through the connection of the button-hole part 111 and button 112. The blade 105 is retained in the protective cover 110. In order to easily connect the button-hole part 111 to the button 112, the button-hole part 111 is connected with a flexible part 113 of the prior art which is widely used in connecting plastic objects providing not only reliable connection therebetween but also favorable flexible performance, as shown in FIG. 16 and FIG. 17. Thus, when the blade 105 is received in the knife handle, even if the locking device is in an unlocked state, the blade 105 is incapable of detaching from the blade holder as long as the protective cover is present. Before using the knife, the button-hole part 111 should be released from the button 112 and then the protective cover 110 is removed from the blade 105; after using, the protective cover 110 is mounted back to sheathe the blade 105 which is received in the handle. It is understood that other detachable mounting method of the prior art may also be used for mounting the protective cover to the utility knife, such as snap button or sticky mat, etc. Although FIGS. 15 to 17 show common folding utility knives with replaceable blade, it is understood that, this restriction means in protective cover method is also adaptable to folding utility knives with replaceable blade having a back-lock or a side-lock mechanism.

Figure 18:
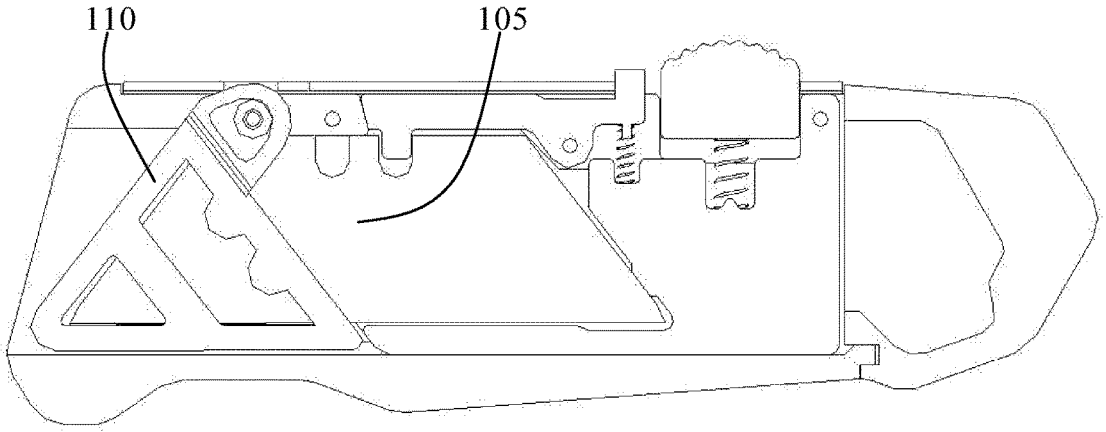
FIG. 18 is a front view of an embodiment of the retractable utility knife with a replaceable knife of the present invention, where the locking device is in a locked state.
Figure 19:
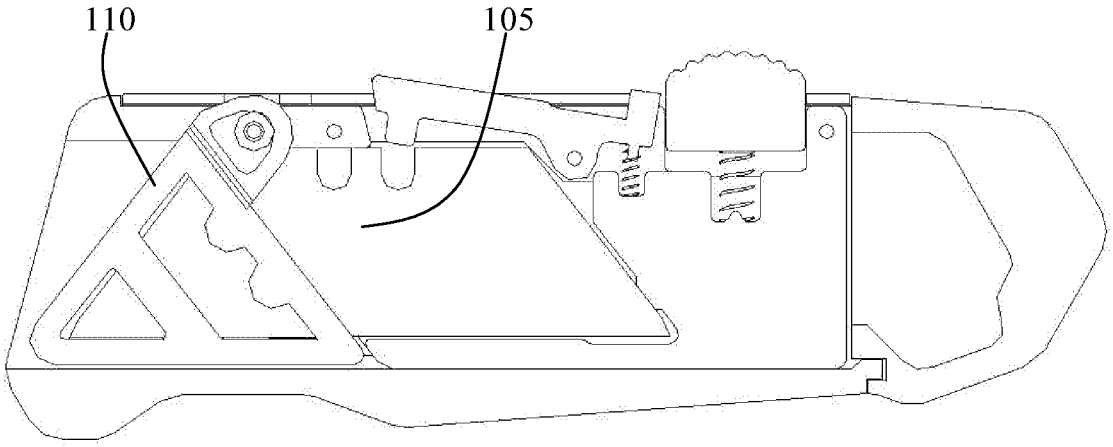
FIG. 19 is a front view of the embodiment as shown in FIG. 18 in unlocked state.

FIG. 18 and FIG. 19 show an embodiment of implementing the protective cover 110 to a retractable utility knife with replaceable blades, where the blade 105 and the protective cover 110 are capable to be received in the knife handle. Similarly, restricted by the protective cover 110, even if the locking device is in an unlocked state, the blade 105 can not detach from the knife as long as the protection 110 is present, as shown in FIG. 18.

Besides, it can be understood by technicians of this field that, the present invention can be alternatively implemented to the utility knives with multiple tools such as shown in FIG. 11 and FIG. 12 (in FIG. 11 and FIG. 12, two blades are respectively disposed at both ends of the knife handle). Therefore, it doesn't matter that, what kind of working parts each tool is, whether the tools are arranged on one end or both ends of the utility knife, and whether the tools are or received in the knife handle in a folding or sliding way, as long as one tool of the utility knife has an aforementioned replaceable blade, the problem that the present invention aims to solve resides therein, and the restriction means of the present invention can then be implemented to eliminate the induced safety hazard of possible detachment of the blade.

The foregoing description details the preferred embodiments of the invention. It should be understood that with the general technique of this field, no inventive work is necessary as to make multiple amendments and changes according to conception of this invention. Therefore, all the technical schemes gained from logical analysis, deductions or limited experimentation based on the conception of the present invention by technicians in this field, should be considered within the protection range asserted in the Claims.

The invention claimed is:

1. A folding utility knife with a replaceable blade, comprising a knife handle, a blade holder, a blade and a locking device that locks the blade in the blade holder, the blade holder and the blade are enabled to be folded and received in the knife handle or to extend out from the knife handle, wherein the utility knife further includes a restriction means which is thus arranged that, when the blade holder and the blade are folded and received in the knife handle and the locking device is in unlocked state, the restriction means is used for preventing the detachment of the blade from the blade holder by restricting the movement of the blade relative to the blade holder;

wherein the restriction means is a projection blocking the blade from detachment thereof from the blade holder;

the folding utility knife with a replaceable blade has a side-lock structure comprising a deflection leaf spring arranged inside the knife handle;

wherein the projection extends out from a side of the deflection leaf spring arranged inside the knife handle.

2. The folding utility knife with a replaceable blade as claimed in claim 1, wherein the projection is formed by bending a part of the deflection leaf spring.

3. A utility knife with a replaceable blade, comprising a knife handle and multiple tools, the tools are enabled to be received in the knife handle respectively via folding or sliding or to extend out from the knife handle, at least one of the tools includes a blade holder, a blade and a locking device that locks the blade in the blade holder, wherein the utility knife further includes a restriction means which is thus arranged that, when the blade holder and the blade are received in the knife handle and the locking device is in an unlocked state, the restriction means is used for preventing the detachment of the blade from the blade holder by restricting the movement of the blade relative to the blade holder;

wherein the blade holder is folded and received in the knife handle or to extend out from the knife handle via folding, and the restriction means is a projection blocking the blade from detachment thereof from the blade holder;

wherein the utility knife with a replaceable blade has a side-lock structure comprising a deflection leaf spring arranged inside the knife handle; wherein the projection extends out from a side of the deflection leaf spring arranged inside the knife handle.

4. The utility knife with a replaceable blade as claimed in claim 3, wherein the projection is formed by bending a part of the deflection leaf spring.

* * * * *